US006224743B1

(12) United States Patent
Satyanarayana

(10) Patent No.: US 6,224,743 B1
(45) Date of Patent: May 1, 2001

(54) CATHODIC PROTECTION METHODS AND APPARATUS

(75) Inventor: Reddi Satyanarayana, Irvine, CA (US)

(73) Assignee: Fluor Daniel, Inc.

( * ) Notice: Subject to any disclaimer, the term of this patent is extended or adjusted under 35 U.S.C. 154(b) by 0 days.

(21) Appl. No.: 09/508,904

(22) PCT Filed: Feb. 6, 1998

(86) PCT No.: PCT/US98/02308

§ 371 Date: Jun. 16, 2000

§ 102(e) Date: Jun. 16, 2000

(87) PCT Pub. No.: WO99/18261

PCT Pub. Date: Apr. 15, 1999

(51) Int. Cl.[7] ..... C23F 13/00

(52) U.S. Cl. ..... 205/740; 205/730; 205/731; 205/732; 205/733; 205/734

(58) Field of Search ..... 205/740, 730, 205/731, 732, 733, 734

(56) References Cited

U.S. PATENT DOCUMENTS

| | | | | |
|---|---|---|---|---|
| 2,240,021 | * | 4/1941 | Rutherford . | |
| 3,202,596 | * | 8/1965 | Canevari | 205/733 |
| 4,496,444 | * | 1/1985 | Bagnulo | 205/740 |
| 5,167,352 | | 12/1992 | Robins | 220/402 |
| 5,292,411 | * | 3/1994 | Bartholomew et al. | 205/733 |
| 5,505,826 | * | 4/1996 | Haglin et al. | 205/733 |

* cited by examiner

*Primary Examiner*—Bruce F. Bell
(74) *Attorney, Agent, or Firm*—Fish & Associates, LLP

(57) ABSTRACT

Apparatus, compositions and methods provide cathodic protection to a structure by placing an anode layer (10) directly between the structure (22) and its underlying foundation (30). Structures contemplated to be protected in this manner include especially very large structures such as above ground storage tanks. In one aspect of preferred embodiments, the anode layer (10) comprises sheets of at least 85% aluminum with other alloying elements such as magnesium (0.05 to 6%), zinc (0.1 to 8%), indium (0.005 to 0.03%) and tin (0.05 to 0.2%) added for the purposes of optimizing current yield, polarization and ease of manufacturing the sheet.

26 Claims, 7 Drawing Sheets

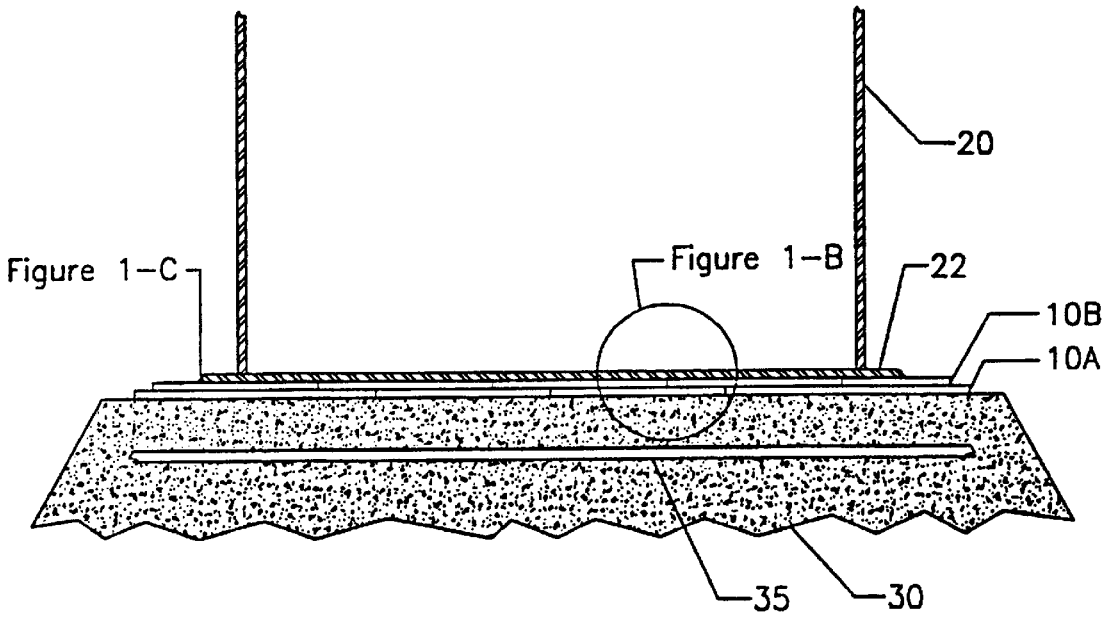
Figure 1-A

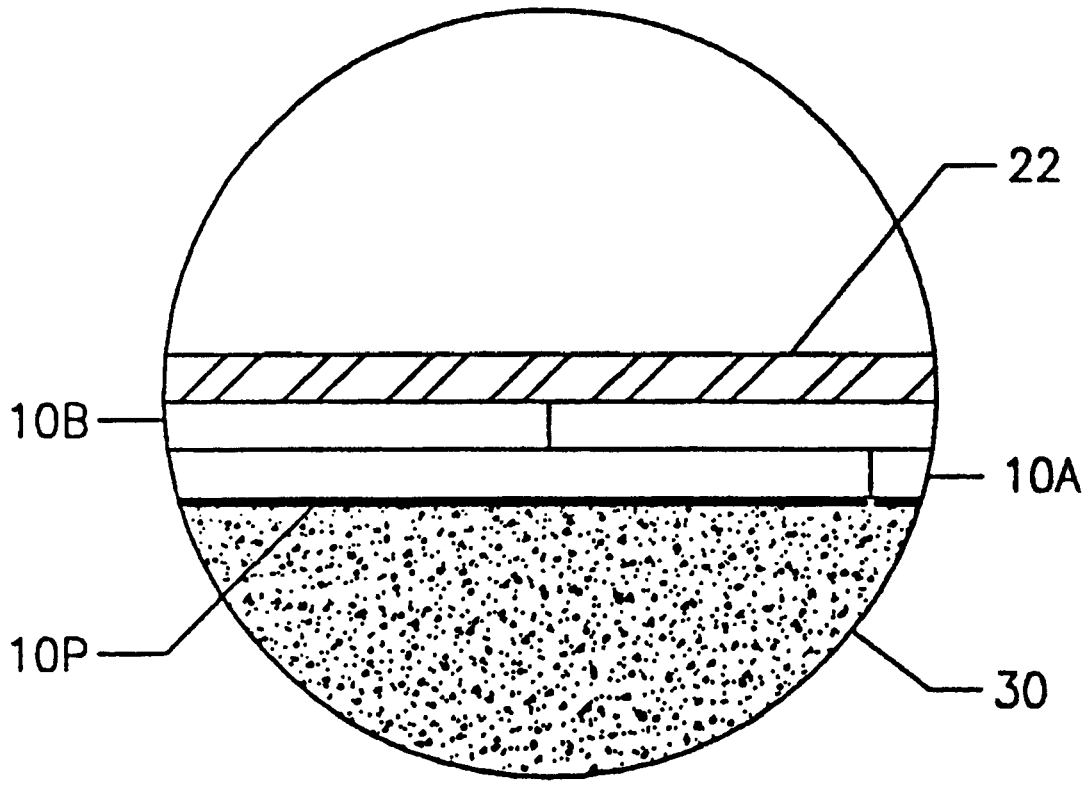
Figure 1-B

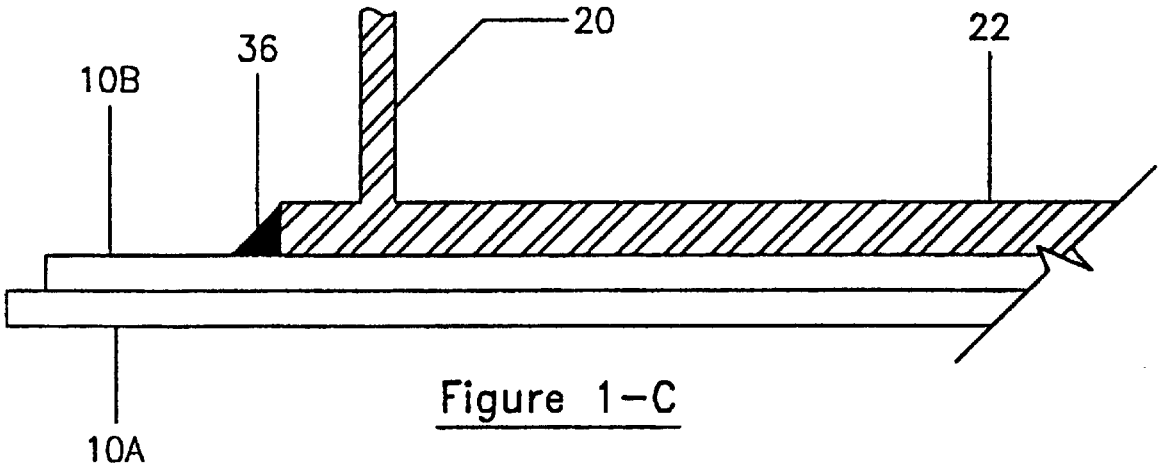
Figure 1-C

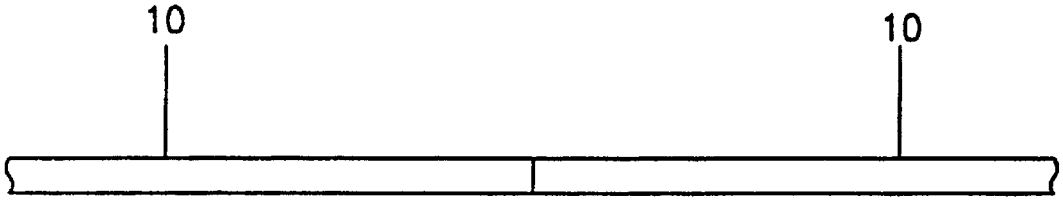
Figure 1-D
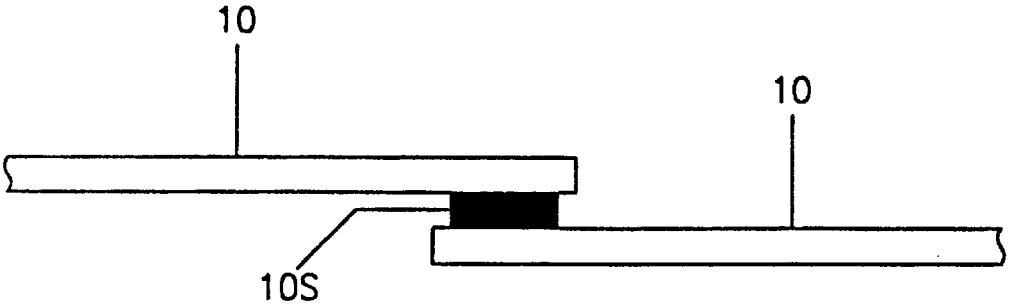
Figure 1-E
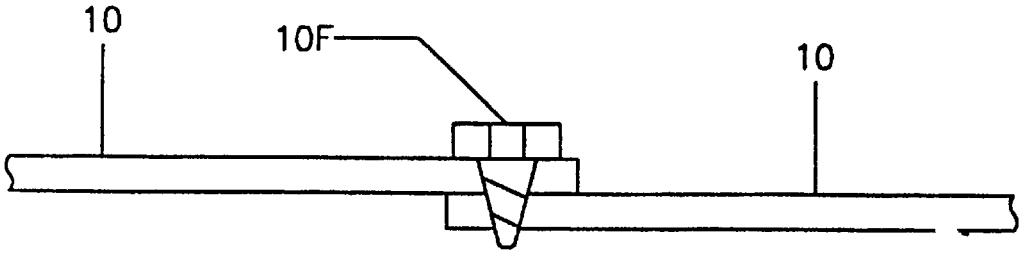
Figure 1-F

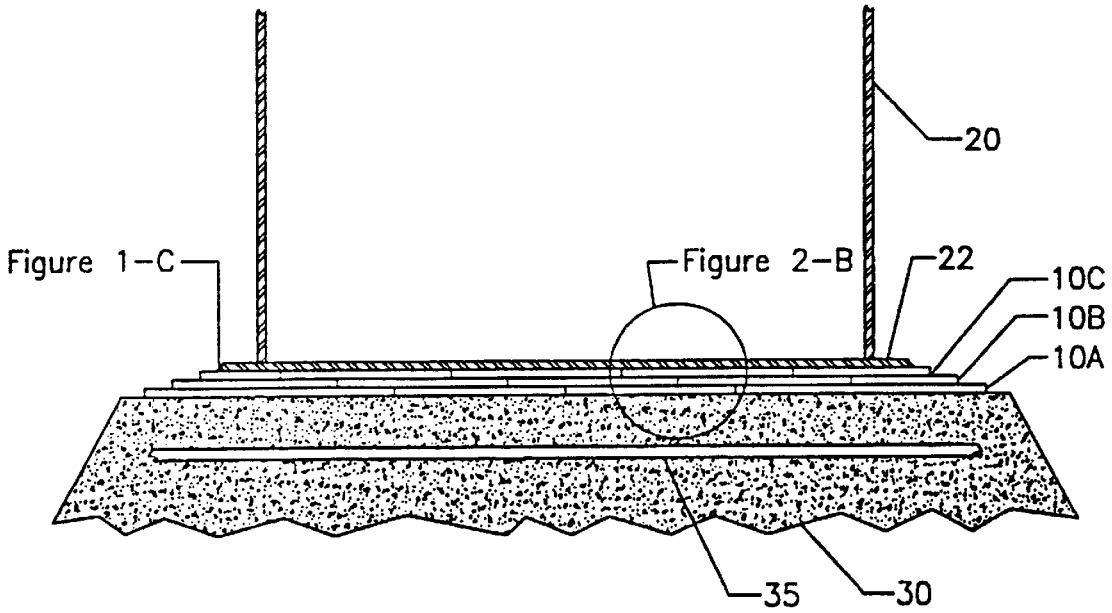
Figure 2-A

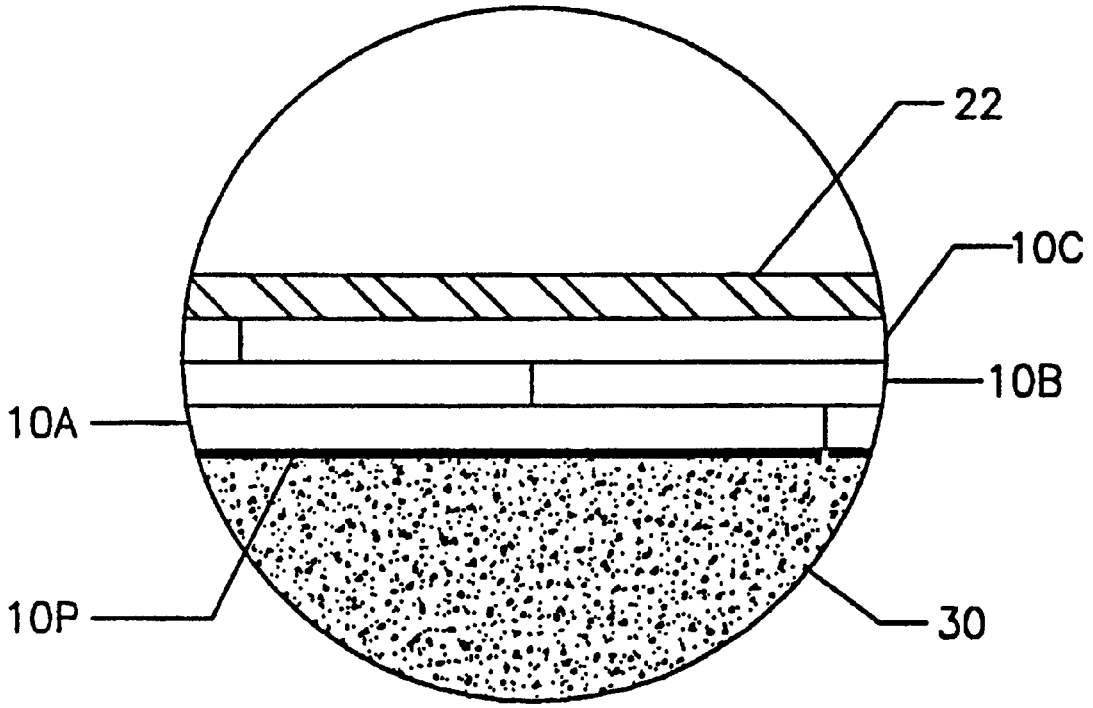
Figure 2-B

CATHODIC PROTECTION METHODS AND APPARATUS

FIELD OF THE INVENTION

This invention relates generally to the phenomenon of corrosion, and more particularly, to the protection of metallic structures or surfaces which are subjected to corrosive conditions. Of special interest is cathodic protection of above-ground storage tank bottoms.

BACKGROUND

It is known that all metallic structures that come in contact with a medium having the properties of an electrolyte are susceptible to the phenomenon of corrosion. Such corrosion tends to destroy the metallic structure and, depending upon the particular corrosive conditions existing, destruction of the metallic structure may occur within a longer or shorter period of time. In many instances significant damage to the metallic structure may occur within a short period of time even though destruction of the metallic structure has not yet occurred.

There are a great many structures subject to corrosion damage, including bridges, pipes, storage tanks, reinforcing steel of concrete structures, structural steel and piles. In most cases the electrolytes for such structures comprise water with dissolved salts and moist soils.

Many techniques have been developed to minimize corrosion. Perhaps the most common method of minimizing corrosion of steel is painting. However, paint is not fully effective for underground and immersion conditions because of a gradual decrease in its resistance which may result from pin-holing and moisture permeation from the corrosive medium to the substrate metal. Corrosion protection in painted steel or steel containing structures is therefore often supplemented with another method commonly known as cathodic protection. Cathodic protection can also be used for unpainted surfaces.

As used herein, the term "cathodic protection" encompasses all manner of preventing or reducing corrosion of structures in electrolytes such as water, soil or chemical solutions using means which are at least partially electrical.

In general, cathodic protection systems operate by utilizing an electrical current to oppose a corrosion current between the structure being protected and an electrolyte. There are basically two known systems for generating opposing electrical currents, "sacrificial systems" and "impressed current systems." In sacrificial systems, the current is supplied by another metal which is galvanically more reactive than the metal of the structure. For example, metals such as aluminum, magnesium and zinc are galvanically more active than steel and are used as "sacrificial anodes" to protect steel structures. In impressed current systems, a consumable metal is used to drain DC current supplied from an external source into the electrolyte which will pass to the structure to be protected. The parts from which the current is drained are called "anodes" and the protected structure is called "cathode." In both sacrificial and impressed current systems of cathodic protection, a metallic path between the anode and the cathode is essential for flow of current to protect the structure.

The design of cathodic protection systems is influenced by numerous factors, including the type of metal to be protected, properties of the electrolyte (chemical, physical and electrical), temperatures, presence or absence of bacteria, shape of the structure, design life, constructability and maintainability. Cathodic protection has been achieved by application of various metallic and polymer webs, tapes, wires, ribbons and bars to a metallic structure being protected. U.S. Pat. No. 4,992,337 to Kaiser et al. (1991), for example, describes an improved arc spray process for applying metals or alloys comprising magnesium, zinc, lithium, and aluminum. The patent also references an article by H. D. Steffans entitled "Electrochemical Studies of Cathodic Protection Against Corrosion by Means of Sprayed Coatings" in Proceedings 7th International Metal Spraying Conference (1974) at p. 123, which describes the arc spray application and corrosion testing of zinc, aluminum, and zinc aluminum pseudo alloy coatings. Still further, U.S. Pat. No. 4,992,337 references an article by P. O. Gartland entitled "Cathodic Protection of Aluminum Coated Steel in Seawater" in Materials Performance June 1987 at p. 29, which reviews the arc spray coating of steel with aluminum 5 wt % magnesium, and summarizes the performance of the coating in seawater.

Cathodic protection using strips or bands of aluminum, zinc, magnesium or alloys thereof is described in U.S. Pat. No. 4,496,444 to Bagnulo (1985). Similarly, U.S. Pat. No. 5,411,646 to Gossett (1995) describes cathodic protection using a braided anode having a mixed metal oxide coating, and U.S. Pat. No. 5,547,560 to LeGuyader (1996) describes cathodic protection of steels and alloys in seawater using a saturated calomel electrode comprising an aluminum based gallium and/or cadmium alloy.

The use of foils in limited circumstances is also known in the field of cathodic protection., but none of the prior uses of foils is particularly viable. U.S. Pat. No. 5,167,352 to Robbins, for example, describes the construction of double wall tanks in which an outer wall envelope of aluminum foil is installed over a prefabricated tank. Robbins' use of aluminum foil is not self-supporting, and the physical strength for the foil is invariably augmented by a resinous coating applied after the installation is completed. The requirement of applying a coating after installation severely limits the applicability of the technology to relatively small tanks (less than 100 feet in diameter) because the tank must be fabricated and hydrotested before application of the aluminum foil envelope. The sequence of events required is: (1) filling the tank with water to check for leaks; (2) emptying the tank; (3) drying the tank interior to prevent inside corrosion; (4) wrapping the aluminum foil to the tank bottom to form an envelope; (5) providing temporary physical support to the foil during the formation of the envelope and lifting of the tank; (6) coating the aluminum foil, seal the overlaps, lift the tank, and position the tank on the foundation; and finally (7) removing the temporary physical support of the foil with sufficient care not to damage the foil and coating laminate.

Robbins' technology is of limited value for other reasons as well. Among other things, all overlaps of the aluminum foil must be completely sealed, as the aluminum foil is intended as a secondary containment. This greatly increases manufacturing difficulties. In addition, Robbins' technology cannot be utilized for existing above ground storage tanks which require replacement of corroded floors.

Other cathodic protection systems utilize wires and wire meshes in place of strips, bands and foils. U.S. Pat. No. 5,340,455 to Kroon et al. (1994), for example, a horizontally disposed cathodic protection anode is positioned between a membrane and the tank bottom, the anode being in the form of a matrix, maze or grid of electrically interconnected coated titanium wires or titanium clad copper wires, and such wires and titanium bars or ribbons. The wires are provided with a mixed metal oxide or noble metal coating.

The bars or ribbons may also be coated. In lieu of the preferred titanium, other suitable metals may be used such as aluminum, tantalum, zirconium or niobium, and alloys thereof.

Still other systems alter the composition of the foundation. U.S. Pat. No. 5,174,871 to Russell (1992), for example, describes corrosion protection of underground structures using a high pH backfill including calcium silicate, calcium nitrate and a hydroxide such as calcium hydroxide or aluminum hydroxide.

In short, despite significant work invested over many years in the development of cathodic protection systems uniform protection is not generally possible with known systems. Among other things such systems continue to be problematic because:

1. The design calculations are performed with "assumed" resistivity of the electrolyte because the actual resistivity varies with time and pressure exerted by the tank bottom during operation which is not known during the design phase of the cathodic protection system:

2. The spacing of the anodes is influenced by the "assumed" resistivity; and

3. There is no proven design method to accurately predict the current distribution from the ribbon and wire systems on the tank plate. The accuracy of methods used to calculate the current distribution from the distributed anodes on the tank plate is questionable as well. If the "assumed" resistivity is not correct, adjustment of the system may not be possible.

Resistivities of the structure's foundation can range from 10,000 ohm-centimeters to 300,000 ohm-centimeters, and variations in resistivities are common from one location to another even within the same foundation. Galvanic anodes, when embedded in the foundation according to current technologies do not work satisfactorily because of high voltage drops between the anode and the structure. Impressed current anodes can be used in such high resistivity mediums, but they generate oxygen and chlorine gas during the chemical reactions, and these gases collect under the structure. Unless the oxygen and chlorine gases are completely purged with inert gas such as nitrogen, pitting corrosion occurs on the tank bottoms. Complete nitrogen purging and verification of its effectiveness is neither practical nor economical.

Still further, tests have shown that installation of impressed current cathodic protection designs should not be used in the annular space of double bottom storage tanks because oxygen that is generated by impressed current anode systems is retained within the closed systems and supports continued corrosion (Reference: Rials S. R. and Kiefer J. H., Conoco Inc, Evaluation Of Corrosion Prevention Methods For Above ground Storage Tank Bottoms. Materials Performance, National Association of Corrosion Engineers, Jan 1993).

Another problem with existing systems is potential damage to the anodes and anode connections after they are embedded in with the soil. To prevent settling of the structure, surrounding soil generally requires compacting, and compacting methods can potentially damage the anodes and anode connections. Compacting methods also affect the electrical resistivity which could be different from the electrical resistivity used in the design of the cathodic protection system.

These problems are particularly apparent when protecting structures such as petrochemical holding tanks because of the large surface area being protected, and difficulties associated with construction of the structures and foundations. Thus, there is still a need for improved cathodic protection systems.

SUMMARY OF THE INVENTION

The present invention is directed to apparatus, compositions and methods which provide cathodic protection to a structure by placing an anode layer directly between the structure and its underlying foundation. Structures contemplated to be protected in this manner include especially very large structures such as above ground storage tanks.

In one aspect of preferred embodiments, the anode layer comprises sheets of at least 85% aluminum with other alloying elements such as magnesium (0.05 to 6%), zinc (0.1 to 8%), Indium (0.005 to 0.03%) and tin (0.05 to 0.2%) added for the purposes of optimizing current yield, polarization and ease of manufacturing the sheet. In another aspect of preferred embodiments, the anode layer comprises at least two overlapping sheets.

Various objects, features, aspects and advantages of the present invention will become more apparent from the following detailed description of preferred embodiments of the invention, along with the accompanying drawings in which like numerals represent like components.

BRIEF DESCRIPTION OF THE DRAWINGS

FIG. 1-A is a schematic of a vertical cross-section of a holding tank and foundation utilizing a SALSA$^{SM}$ system.

FIG. 1-B is an expanded view of two anode sheets shown in FIG. 1-A.

FIG. 1-C is a schematic of a weatherproofing sealant disposed at a junction of a tank plate edge and an anode sheet.

FIG. 1-D is a schematic depicting butt-jointed anode sheets of an anode layer.

FIG. 1-E is a schematic of a sealant in an overlapped interface area of two anode sheets.

FIG. 1-F is a schematic of a screw at the overlap of two anode sheets.

FIG. 2-A is a schematic of a vertical cross-section of a holding tank and foundation utilizing an alternative SALSA$^{SM}$ system.

FIG. 2-B is an expanded view of three anode sheets shown in FIG. 2A.

DETAILED DESCRIPTION

Figure 3:
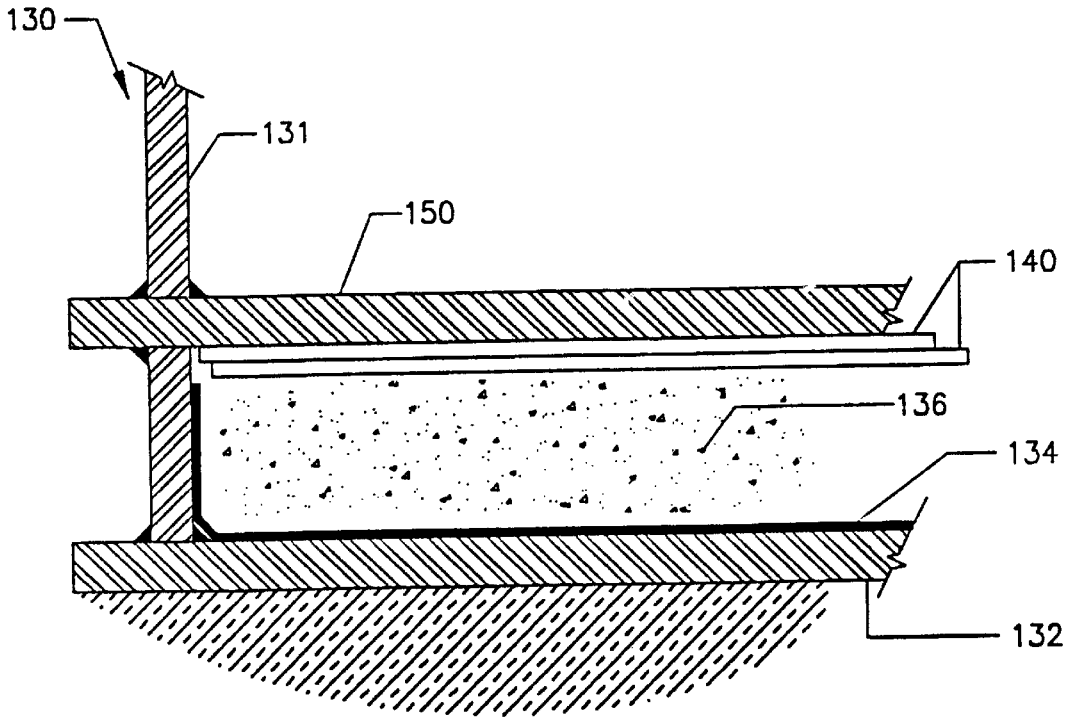
FIG. 3 is a schematic of a holding tank, an older corroded tank bottom, and a new tank bottom protected with a SALSA$^{SM}$ system.

Systems which include apparatus, compositions and methods according to the inventive subject matter hereinafter may be generically referred to as SALSA$^{SM}$ (Sacrificial Aluminum Sheet Anode) systems. In a preferred embodiment of such systems shown in FIGS. 1A and 1B, two or more anode layers of aluminum sheets 10 are positioned below the bottom 22 of a tank 20. The aluminum sheets 10 rest upon a layer of sand 30 which contains a plastic liner or other relatively impermeable moisture barrier 35.

As used herein, the term "corrosive medium" means any medium containing an electrolyte which is corrosive to, or promotes corrosion of, a metallic component of a structure. Corrosive media include foundation media such as river sand, silica sand, native soil, clay, crushed rock, gravel and any medium engineered to support the weight of the filled tank. Sand is one of the most common foundation mediums, and is therefore used in various Figures to indicate the corrosive medium.

As used herein, the term "structure" means any structure having a metallic surface or other component which is disposed in long-term contact with an electrolyte, and is thereby subject to corrosion. Contemplated structures include petrochemical storage tanks, water storage tanks, commercial, industrial and residential buildings, and bridges. Specifically included are above ground storage tanks with single bottoms, and existing above ground storage tanks with corroded floors, and/or multiple bottoms.

As used herein, the term "anode layer" means any galvanically active stratum which is structurally substantially separable from both the structure being protected and the corrosive medium. This definition is quite broad, including, for example, a stratum which comprises a foil, sheet or plate, or an assembly thereof, even if such stratum is bolted or welded to the structure. Embodiments may have one or more such anode layers, and such layers may be placed contiguously with or without overlaps, with or without staggered arrangement, with or without sealant in the overlaps, and with or without mechanical fasteners at the overlaps. Further examples of contemplated anode layers are: a plastic sheet or other barrier upon which a metal or metallic composition is deposited; an aluminized plastic sheet; and a zinc coated steel sheet. In such anode layers, the deposition could arise by any suitable means, including painting, vapor deposition, thermal spraying, hot-dip galvanizing, electro-depositing, mechanical galvanizing, plasma coating. It is contemplated that at least one of anode layers in preferred embodiments will be manufactured from a metal which is galvanically more active than the structure it is protecting. Aluminum is preferably used for an anode layer because most tank bottoms are comprised primarily of steel, and aluminum is galvanically more active than steel. While other metals (which term is used herein to include alloys) may be galvanically more active than aluminum when in contact with iron and iron including metals, aluminum has additional advantages such as low cost, light weight, and malleability.

It is important to note that the term "anode layer" as used herein does not encompass strata which are structurally substantially inseparable from either the structure being protected or the corrosive medium. Thus, for example, an anode layer as contemplated herein would not encompass aluminum paint which is spray painted directly onto the bottom of a structure being protected. Such paint would presumably be strongly adhered onto the structure, and would therefore not be structurally substantially separable from the structure. On the other hand, the term "anode layer" would include aluminum paint intermixed with the upper surface of a foundation of packed sand, because the anode layer is still substantially separable from the remainder of the sand.

In FIGS. 1A and 1B the aluminum sheets 10 are each preferably approximately 36 or 48 inches wide by about 0.020 inches thick, and comprise aluminum alloys 3003, 3004, 3005, 3105, 5005, 5010, 7006, 7011, 7075 and 7178 (ASTM B-209) with a minimum of approximately 85% aluminum content. It should be appreciated, however, that other numbers of sheets, sheet sizes, and sheet compositions may be utilized.

In other embodiments, the sheets may contain different percentages of aluminum. Still further, while the sheets in many instances should be flat and smooth, it is contemplated that such sheets may contain some degree of corrugation, embossing or other surface pattern to increase friction in earthquake prone zones. With respect to widths and lengths, the sheets may vary considerably from the present standards provided by the aluminum suppliers.

The aluminum sheets 10 of FIGS. 1A and 1B are preferably laid on the foundation with staggered joints under the plates of the tank bottom 22. Sheets in the lowest anode layer 10A are laid directly on the foundation, and may have a factory applied moisture barrier 10P such as a polymeric coating (epoxy and acrylic) or a plastic laminate (such as Tedlar™ ) on the soil side. The top side of anode layer 10A preferably would not have any type of coating. A moisture barrier 10P is not necessary for performance of this system, however, it is included because it is a very low cost item and is expected to prolong the anode life. It is contemplated that all such moisture barriers 10P are optional.

Sheets in the upper anode layer 10B preferably have both sides plain, without any electrically insulating material. Anode layer 10B sheets should be placed directly on anode layer 10A sheets, and should have direct metal-to-metal contact with both anode layers 10A sheets and the tank plate.

FIGS. 1-D, 1-E and 1-F show various possible arrangements of aluminum sheets 10 of each anode layer.

In FIG. 1-D, aluminum sheets 10 are placed next to each other without overlaps.

In FIG. 1-E, aluminum sheets 10 are placed in an overlapping pattern with an optional moisture resistant sealant 10S in the overlap area.

In FIG. 1-F, aluminum sheets 10 are placed in an overlapping pattern and the overlap is mechanically fastened with screw 10F.

It is important to note that the aluminum sheets 10 of any layer can be arranged independent of the method of arrangement of the other layers. For example, aluminum sheets 10 of anode layer 10A can be arranged as shown in FIG. 1-E and aluminum sheets 10 of anode layer 10B can be arranged as shown in FIG. 1-D.

In preferred embodiment of the invention, the anode layer is installed to cover 100% of the top area of the corrosive medium on which the structure would be placed. However, anode layers can be installed to cover less than 100% of the top area of the corrosive medium if partial cathodic protection of the structure is acceptable.

In FIGS. 2A and 2B, a plurality of bottom sheets 10 are placed on a foundation comprising sand 30 (corrosive medium) and a moisture barrier 35. As discussed above, each of the sheets in the lowest anode layer 10A is preferably approximately 0.020 inches thick, and are preferably installed with a coated side down and bare/uncoated side up.

Two or more additional anode layers 10B, 10C of aluminum sheets, also approximately 0.020 inches thick, but with both sides plain (without electrically insulating material on any side) are then installed on top of the lowest anode layer 10A in a staggered pattern, with overlap preferably about 24 inches. The final anode layer of sheets 10C are in contact with the tank bottom 22. In this manner most or all of the foundation is covered in aluminum sheets, and most or all of the tank bottom 22 is in contact with aluminum sheets.

In especially preferred embodiments, the sheets should extend beyond the tank plate rim by a minimum of ¼th inch for new tanks. If desired, an optional weather resistant caulking compound 36 may be applied in the corner area on the weather exposed side of the tank plate rim and the aluminum sheet to prevent any rain water from entering into the interface area of the anode layer and the tank floor plate as shown in FIG. 1C.

In FIG. 3, a SALSA$^{SM}$ system is used in conjunction with an existing tank and foundation. Here, a tank 130 has a shell 131 and a previously installed, generally corroded floor 132. A dielectric barrier (usually a 40 to 80 mils thick polyethylene sheet or a monolithic coating) 134 is laid on top of the corroded floor 132, and a layer of sand 136, preferably from about four to about six inches thick, is placed on top of the dielectric barrier 134. One or more, anode layers of aluminum sheets 140 are then placed on top of the sand 136, and finally a new tank bottom 150 is placed on top of the aluminum sheets 140. The arrangement of these aluminum sheets 140 can be in substantially the same manner as the aluminum sheets 10 shown in FIGS. 1-D, 1-E and 1-F. This system substitutes for previously known systems in which about 1 inch of sand is placed on top of a dielectric barrier. A conventional cathodic protection system consisting of mixed metal oxide anodes (ribbon, grid or coils) is placed on the sand, then a subsequent layer of about five inches of sand is placed on top of the anodes.

Storage tank bottoms, when positioned on a corrosive medium, have natural electrical potentials which are more corrosive at the center and relatively less corrosive towards the outer edge of the tank bottom. To compensate for this variation in corrosive potentials, cathodic protection systems should be designed to provide more cathodic protection current at the center of the tank than the cathodic protection current for the perimeter of the tank bottom, and this can be accomplished by providing a higher mass of the anode at the center than at the perimeter. To provide such varied anode quantities, SALSA$^{SM}$ systems for large petrochemical storage tanks, such as those having a footprint diameter of at least 100 feet, may advantageously comprise 3 anode layers within 25 feet, two anode layers from within 25 to 40 ft, and one anode layer within 40 feet to 50 feet of the radial distance measured from the center of the tank. In alternative embodiments, the thickness of the sheets can be varied rather than the number of layers. Some of the parameters which affect the design of such variation in anode mass are tank size, thickness of the anode sheet, foundation soil, amount of rain fall and its drainage away from the tank, and design life of the tank.

SALSA$^{SM}$ systems as described herein have significant advantages over previously known systems. Among other things, aluminum sheets are essentially impermeable to moisture, and therefore prevent migration of ground moisture to the structure except, potentially, at the sheet overlap. An organic sealant 10S at the sheet overlap may also be used to prevent the migration of ground moisture through the overlap. However, even without such sealant 10S, the pressure exerted by the floor plates on the aluminum sheet overlaps, will prevent moisture migration at the sheet overlaps.

Another advantage of SALSA$^{SM}$ systems is that aluminum sheets can be placed in direct contact with up to 100% of the tank plate, providing uniform protection independently of the foundation resistivity. The degree of contact between aluminum and tank plate is especially enhanced by the conformability of aluminum at the lap joints of floor plates of the tank when the tank is filled due to the considerable weight brought to bear on the tank bottom.

Another advantage is that in SALSA$^{SM}$ systems, there is no need for complete fabrication and pressure testing of the tank before the anode installation. Instead, the tank floor can be fabricated directly on top of the anode sheets, or alternatively, the anode installation and the tank floor fabrication can be performed in increments.

SALSA$^{SM}$ systems are also advantageous in that structures being protected may have, but do not require, application of inorganic or organic coatings. Organic coatings are required on structures for most other known cathodic protection systems, and are subject to damage during welding of structure components and attachments for interior cathodic protection system on the floor. The first problem can be mitigated by leaving the structure edges bare. However, the bare surfaces require more cathodic protection current while the coated surfaces require less current, and it is difficult to satisfy the additional cathodic protection requirements by known cathodic protection systems. The second problem relates to damage to the organic coating Where attachments to fasten the interior floor anodes are welded. Such damage under the floor generally cannot be repaired, carbonized coating acts as a cathode and will promote corrosion of the floor from the foundation side if sufficient cathodic protection current is not available.

Organic coatings which are required with other cathodic protection technologies on tank plates are also problematic in that they may be cathodically disbonded from the substrate metal at cathodic protection voltages below −1.2V (measured with copper-copper sulfate reference electrodes). For safety reasons, tanks containing flammable fluids should be fully grounded and should eliminate electrical isolation at nozzles to avoid electrical sparking during lightning. In such cases, the grounding system draws a substantial amount of current from the conventional cathodic protection systems, and only a small portion of such current would be available for corrosion protection. One possible solution is to increase the current output from the rectifier, but, when the current output from the rectifier is increased coated areas of the structure close to the anode may be subjected to cathodic disbandment due to excessive cathodic protection voltage. Disbonded coatings generally shield the substrate metal from cathodic protection currents, thereby reducing the adequacy of the cathodic protection. This kind of problem is eliminated with SALSA$^{SM}$ systems both because an organic coating is not required on the structure, and because the anode sheets are in direct contact with the uncoated structure.

SALSA$^{SM}$ systems have particular advantages compared with systems utilizing zinc containing anodes such as zinc ribbon. Zinc anode systems are limited to operating temperatures less than 140° F. because zinc reverses its polarity at temperatures from 140° F. to 250° F. when moisture is present. Zinc promotes corrosion of steel when its polarity is reversed and therefore can not be used for protection of tanks with hot hydrocarbons (residuum) which operate at temperatures of about 250° F. Aluminum has no such reverse polarity and can be used at all temperatures up to 1,200° F. Also, impressed current anode systems should not be used under hot structures because higher current output which is required at higher temperatures also generates a higher amount of oxygen. The pitting corrosion of the structure increases with increased presence of oxygen. Again, the SALSA$^{SM}$ system is a better choice when compared to impressed current anode systems because the oxygen generated by SALSA$^{SM}$ system is insignificant.

As discussed in part above, SALSA$^{SM}$ systems have several advantages compared with other systems by virtue of their independence from soil or other foundation conditions. For example, while other systems may not prevent ground moisture from reaching the structure, the anode sheets in SALSA$^{SM}$ systems can be entirely impermeable to water. Similarly, design of other systems is based on the assumptions that the soil resistivity is uniform under the structure, and that all of the steel areas of the tank will receive equal current density. In SALSA$^{SM}$ systems these considerations are irrelevant because current flow is independent of soil resistivity. Burn-out of anode connections, current attenuation, and electrical grounding are also irrelevant to SALSA$^{SM}$ systems. Similarly, reference electrodes need not, and preferably are not installed with SALSA$^{SM}$ systems.

SALSA$^{SM}$ systems have still other advantages relative to previously known systems. For example, impressed current systems generate stray currents which can damage the rebar of the tank ring wall, while such problems do not exist with SALSA$^{SM}$ systems. Other advantages relate to engineering and construction. For example, engineering time of SALSA$^{SM}$ systems is reduced to one or two hours, which is lower than with other systems. SALSA$^{SM}$ systems also do not require skilled labor for installation, and such systems help improve schedules for shipment of tank plates to project sites because painting operations for the structure are reduced. In addition, suitable aluminum sheets are readily available or have short lead time. Electrical cables, test stations, etc. are not required. Still further, anode installation and floor construction are concurrent rather than sequential. This saves 2 to 3 weeks of construction time.

SALSA$^{SM}$ systems also have operating advantages. For example, SALSA$^{SM}$ systems are automatically operational, and protect the floor plate as soon as the floor plate is laid on the aluminum sheets. There is no need for start up procedures for cathodic protection or temporary protection. Still further, test stations are not required because the entire surface of the structure is isolated from the foundation soil.

Thus, specific embodiments and applications of SALSA$^{SM}$ systems have been disclosed. It should be apparent, however, to those skilled in the art that many more modifications besides those already described are possible without departing from the inventive concepts herein. The inventive subject matter, therefore, is not to be restricted except in the spirit of the appended claims.

What is claimed is:

1. A method of providing cathodic protection to an exterior metallic surface of a structure which is subject to corrosion from a medium, comprising:

providing an anode layer which is galvanically more active than that of the metallic surface;

placing the anode layer between the medium and the structure; and positioning the metallic surface such that the anode layer has a direct current connection with the metallic surface of the structure.

2. The method of claim 1 wherein the structure comprises an above ground storage tank having a metallic bottom.

3. The method of claim 1 further comprising providing a foundation under the anode layer, including at least one of a soil, a sand, a clay, and a gravel.

4. The method of claim 1 wherein the anode layer comprises a plurality of overlapping sheets.

5. The method of claim 1 wherein the anode layer comprises at least one of a foil, a sheet, and a plate.

6. The method of claim 1 wherein:

the structure has a central portion and a perimeter portion juxtaposing the medium;

the anode layer comprises anode sheets to produce x units of cathodic protection current juxtaposing the central portion; and the anode layer comprises anode sheets to produce y units of cathodic protection current juxtaposing the perimeter portion wherein x is greater than y.

7. The method of claim 1 wherein the anode coating has a corrosive medium side, and further comprising providing the anode layer with a corrosion resistant coating on the corrosive medium side.

8. The method of claim 1 further comprising placing the anode layer in direct contact with the structure.

9. The method of claim 1 further comprising utilizing the anode layer as a barrier to electrolyte migration from the medium to the structure.

10. The method of claim 1 wherein the structure has load bearing components, and further comprising fabricating the structure on the anode layer.

11. The method of claim 1 wherein the anode layer comprises overlapping parts.

12. The method of claim 11 wherein the overlapping parts define an overlap, and further comprising sealing the overlap.

13. The method of claim 11 wherein the overlapping parts define an overlap, and further comprising mechanically fastening the overlap.

14. The method of claim 1 further comprising providing the anode layer with an electrically conductive coating.

15. The method of claim 1 further comprising providing the anode layer as a plurality of at least partially overlapping sheets comprising predominantly a metal selected from at least one of aluminum, zinc and magnesium.

16. The method of claim 15 wherein the anode layer comprises predominantly aluminum, and further comprises one or more of alloying elements of indium, magnesium, tin and zinc.

17. The method of claim 15 wherein the anode layer comprises predominantly zinc.

18. The method of claim 15 wherein the anode layer comprises predominantly magnesium.

19. The method of claim 15 further comprising providing the anode layer with a surface configuration which improves friction between the anode layer and the structure.

20. The method of claim 19 further comprising providing an anode layer with a surface configuration which improves friction between the anode sheets.

21. The method of claim 15 further comprising providing the anode layer with contiguous and overlapping multiplicity of sheets and foils.

22. The method of any of claims 1–21 wherein the structure includes a tank having a floor plate in contact with a tank fluid, and further comprising placing the anode layer under the floor plate.

23. The method of any of claims 1–21 further comprising lowering at least a portion of the tank bottom surface into the foundation.

24. The method of any of claims 1–21 wherein the structure has a weight, and an electrical contact occurs between the metallic surface and the anode layer, wherein the electrical contact is substantially maintained by the weight of the structure.

25. The method of any of claims 1–21 wherein the structure comprises a double tank bottom.

26. The method of claim 1 wherein the anode layer comprises overlapping parts.

* * * * *

UNITED STATES PATENT AND TRADEMARK OFFICE

CERTIFICATE OF CORRECTION

PATENT NO. : 6,224,743 B1
DATED : May 1, 2001
INVENTOR(S) : Satyanarayana Reddi

It is certified that error appears in the above-identified patent and that said Letters Patent is hereby corrected as shown below:

Title page,
Item [75], Inventor: replace "Reddi Satyanarayana" with -- Satyanarayana Reddi --

Signed and Sealed this

Nineteenth Day of February, 2002

*Attest:*

*Attesting Officer*

JAMES E. ROGAN
*Director of the United States Patent and Trademark Office*